United States Patent [19]

Jenz et al.

[11] Patent Number: 4,739,730

[45] Date of Patent: Apr. 26, 1988

[54] COOLING SYSTEM BALANCING RESERVOIR ARRANGEMENT

[75] Inventors: Siegfried Jenz, Illingen; Helmut Dobler, Hemmingen, both of Fed. Rep. of Germany

[73] Assignee: Suddeutsche Kuhlerfabrik, Julius Fr. Behr GmbH & Co. KG, Stuttgart, Fed. Rep. of Germany

[21] Appl. No.: 902,700

[22] Filed: Sep. 2, 1986

[30] Foreign Application Priority Data

Sep. 17, 1985 [DE] Fed. Rep. of Germany ..... 3533095

[51] Int. Cl.[4] ..... F01P 11/02

[52] U.S. Cl. ..... 123/41.54; 73/49.3; 123/41.27

[58] Field of Search ..... 123/41.27, 41.51, 41.54; 165/104.27, 104.32; 73/46, 49.2, 49.3

[56] References Cited

U.S. PATENT DOCUMENTS

| | | | |
|---|---|---|---|
| 4,492,267 | 1/1985 | Cadars | 123/41.54 |
| 4,580,622 | 4/1986 | Sigonneau | 123/41.54 |

FOREIGN PATENT DOCUMENTS

| | | |
|---|---|---|
| 1501512 | 9/1966 | Fed. Rep. of Germany . |
| 1601229 | 1/1968 | Fed. Rep. of Germany . |
| 2852725 | 6/1980 | Fed. Rep. of Germany . |

*Primary Examiner*—Tony M. Argenbright
*Assistant Examiner*—Eric R. Carlberg
*Attorney, Agent, or Firm*—Barnes & Thornburg

[57] ABSTRACT

A coolant expansion tank, consists of a filling chamber for receiving the coolant and an expansion chamber connected via a connecting line and separated by a double-walled partition forming a monitorable testing space. The connecting line is led through and between the two walls of the double-walled partition. Openings to the exterior are provided in the testing space to dispurse any testing agent resulting from a leak in the partition or connecting line.

9 Claims, 2 Drawing Sheets

FIG. 2
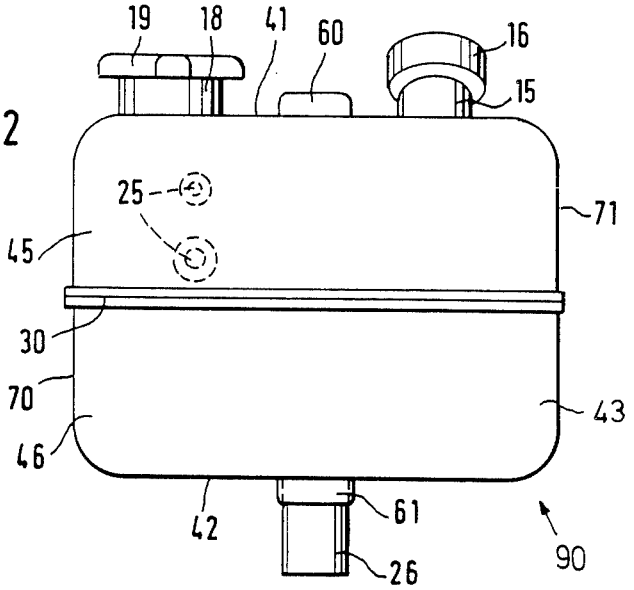
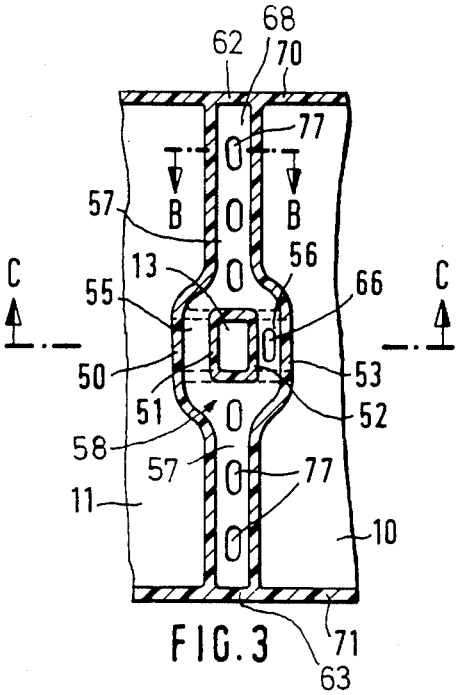
FIG. 3
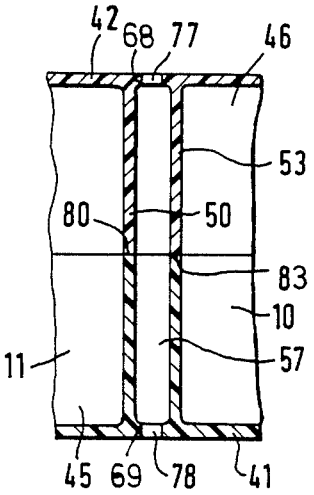
FIG. 4

COOLING SYSTEM BALANCING RESERVOIR ARRANGEMENT

BACKGROUND AND SUMMARY OF THE INVENTION

This invention relates to a coolant expansion tank, particularly for motor vehicle internal-combustion engines, having at least one filling chamber for receiving the coolant and at least one expansion chamber that is separated from the filling chamber by means of a partition wall.

A coolant expansion tank of this type is known from DE-OS No. 2,852,725. There, the tank, by means of a vertically arranged partition, is divided into a filling chamber and an expansion chamber. The upper area of the filling chamber, via a connecting line, is connected with the lower area of the expansion chamber. Normally, the filling chamber is filled with the coolant up to a certain level. For example, because of a high operating temperature of the internal-combustion engine to be cooled, the coolant is heated and therefore expands. This has the result that the coolant from the filling chamber, via the connecting line, overflows into the expansion chamber. In the case of a subsequent cooling of the coolant, it is, by means of a vacuum, again drawn back from the expansion chamber into the filling chamber. For the operatability of a coolant expansion tank of this type, especially for the following-back of the coolant from the expansion tank into the filling chamber by means of a vacuum, it is not only important that the exterior walls of the coolant expansion tank are tight, but also that the partition separates the expansion chamber and the filling chamber tightly from one another.

It is the objective of the invention to provide a coolant expansion tank, particularly for motor vehicle internal-combustion engines, in which simultaneously with the checking of the exterior walls of the coolant expansion tank concerning their tightness, also the partition separating the filling chamber and the expansion chamber from one another can be examined with respect to its tightness.

These and other objectives are achieved by forming the position between the filing and expansion chambers as double wall having a monitorable checking space therebetween.

This development of the partition makes possible a checking of the tightness of said partition. For checking the tightness of the coolant expansion tank, a test agent, possibly under pressure, is filled into the coolant expansion tank. If the partition is not tight, the test agent comes out in the testing space formed by two walls of the double wall. This can be determined by monitoring the testing space so that in this manner, the checked coolant expansion tank can be recognized as being leaky. Leaky points of the exterior wall of the coolant expansion tank can be determined in the same working cycle by the emerging of the testing agent at the corresponding points of the exterior valve.

In an advantageous development of the invention, the two wall of the partition are made into a testing chamber by means of transverse walls. In this way, a closed testing chamber is formed. In the case of one embodiment, the exterior walls of this testing chamber are the same dimension as the exterior walls of the adjacent filling chamber and expansion chamber.

For the monitoring of the testing chamber, in the case of a further development of the invention, at least one transverse wall has at least one opening leading to the outside. If the partition between the filling chamber and the expansion chamber is leaky, testing agent, as described above, will enter the testing chamber and go to the outside through the opening. The leakiness of the partition can therefore be recognized by the fact that testing agent emerges from the opening. It is advantageous to provide openings of this type at all exterior walls of the testing chamber so that the orientation of the coolant expansion tank is not important during its leak test.

In a further development of the invention, it is provided that between the two walls of the partition, a connecting line is arranged that connects the filling chamber and the expansion chamber with one another. Thus, the connecting line is integrated into the coolant expansion tank, which is particularly advantageous for the manufacturing and the operability of the coolant expansion tank. Also by providing the connecting line between both walls of the testing space, the tightness of the connecting line is checked simultaneously with the leak test of the coolant expansion tank and particularly of the partition. The reason is that, if the connecting line is leaky, testing agent will emerge from the connecting line into the testing space which can be determined as described above.

For the manufacturing of the coolant expansion tank, it is advantageous for the coolant expansion tank to consist of at least two housing parts that are fitted together along a parting line forming a joining plane. If, in this case, the joining plane intersects with the partition, simultaneously with the leak test of the partition, the partying line of the joining plane intersecting with the partition is also checked with respected to its tightness. Therefore, during the construction of the coolant expansion tank, attention does not have to be paid as to how the joining plane extends, for even when a parting line intersects with the partition and thus the possibility of leakiness of the partition because of a leaky parting line is increased, this type of leakiness can be determined reliably.

Another advantage of the coolant expansion tank according to the invention is the fact that the design of the filling chamber and the expansion chamber, the arrangement and development of the wall forming the testing space, the design and course of the connecting line within the testing space as well as the position of the joining plane of the two halves of the housing of the coolant expansion tank can be selected completely arbitrarily. The same is true for the method of manufacturing of the coolant expansion tank. It is particularly advantageous to construct the coolant expansion tank as an injection-molded part made of plastic.

Further objects, features, and advantages of the present invention will become more apparent from the following description when taken with the accompanying drawings which show, for purposes of illustration only, an embodiment in accordance with the present invention.

BRIEF DESCRIPTIQN OF THE DRAWINGS

FIG. 2 is the view of a narrow side of the coolant expansion tank of FIG. 1;

FIG. 3 is a partial section along the plane A—A of FIG. 1; and

FIG. 4 is a section along Line B—B shown in FIG. 3.

DETAILED DESCRIPTION OF THE DRAWINGS

Figure 1:
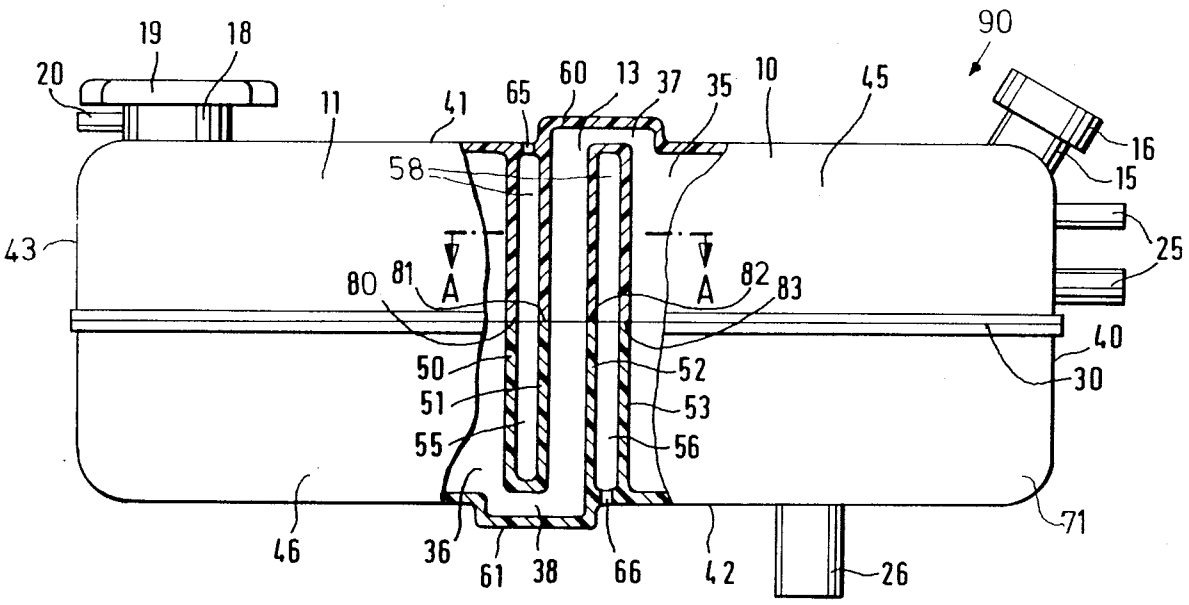
FIG. 1 is a lateral view of a coolant expansion tank according to the invention that is partially cut open along the plane C—C shown in FIG. 3.

In the case of a coolant circulating system of an internal combustion engine of a motor vehicle, coolant that was heated in the cooling jacket of the internal-combustion engine is pumped through a heat exchanger. For increasing the operatability, it is known to connect the heat exchanger and possibly the cooling jacket of the internal-combustion engine in parallel with the coolant circulating system with a coolant expansion tank connected to the pump. This has the objective of catching the volume expansion of the coolant occurring because of the heating of the coolant. This can be achieved by dividing the coolant expansion tank into a filling chamber and an expansion chamber. In addition, the coolant expansion tank has the objective of making possible the separation of gas bubbles that may have been created during the heating from the coolant. This is, among other things, achieved by the fact that the circulating speed of the coolant in the coolant expansion tank is much slower than in the actual circulating system so that inside the coolant expansion tank, the separation of gas bubbles from the coolant can take place.

In FIG. 1, a coolant expansion tank 90 is shown that is intended for being installed in a motor vehicle. The fitting position of the coolant expansion tank 90 in the motor vehicle corresponds to the orientation shown in FIG. 1. The coolant expansion tank 90 consists essentially of a filling chamber 10 and an expansion chamber 11 which are connected with one another via a connecting line 13. In FIG. 1, the filling chamber 10 is arranged in the right-hand area of the coolant expansion tank 90, while the expansion chamber 11 is located in the left-hand area. The connecting line 13 is provided in the center of the coolant expansion tank 90 and has an S-shape. The longitudinal side 71 of the coolant expansion tank 90 shown in FIG. 1 has an essentially oblong rectangular shape. On the whole, the coolant expansion tank 90 is essentially a rectangular cuboid.

On the top side 41 of the coolant expansion tank 90, adjacent to the right front side 40 of said coolant expansion tank 90, round feeding connection piece 15 is mounted that points away diagonally and is closed by a removable cap 16. Below the feeding connection piece 15, on the front side 40, two round inlet connection pieces 25 are arranged below one another. On the bottom side 42 of the coolant expansion tank 90, a round suction connection piece 26 is finally located approximately in the center of the area of the filling chamber 10. This suction connection piece 26 as well as the inlet connection pieces 25 project away from the coolant expansion tank 90 and have a constant diameter. Via the feeding connection piece 15, the filling chamber 10 can be replenished with coolant; via the inlet connection pieces 25, coolant is directed to the filling chamber 10 from the heat exhanger and/or the cooling jacket of the internal-combustion engine; and via the suction connection piece 26, coolant is sucked from the filling chamber 10 by the pump.

In the area of the left front side 43 of the coolant expansion tank 90, a round valve connection piece 18 is mounted on the top side 41 of said coolant expansion tank 90, and is closed, for example, by a cap 19 that can be rotated to be opened. The valve connection piece 18 is connected with the expansion chamber 11 so that, in the case of a predeterminable pressure in the expansion chamber 11, a pressure control valve (not shown) that is integrated into the cap 19 opens and coolant, via an overflow pipe 20 connected with the pressure control valve, emerges from the coolant expansion tank 90 until the pressure control valve closes again because of a pressure reduction.

The connecting line 13 leads from an upper area 35 of the filling chamber 10 to a lower area 36 of the expansion chamber 11. It is arranged essentially vertically in the center of the coolant expansion tank 90 and, via a duct 37, is connected to the mentioned upper area 35 and, via a duct 38, is connected to the mentioned lower area 36. The ducts 37 and 38 extend essentially horizontally by means of which the initially mentioned S-shape of the connecting line 13 is obtained.

The duct 37 is arranged higher than the filling chamber 10 so that when the filling chamber is completely filled with coolant, a gas separation is possible. This is achieved by the fact that the exterior wall 60 of the duct 37 projects above the exterior top side 41 of the coolant expansion tank 90. Similarly, the exterior wall 61 of the duct 38 is developed so that it projects below the bottom side 42 of the coolant expansion tank 90. This has the result that, when the coolant is cooled, all coolant can be withdrawn from the expansion chamber 11 by means of vacuum into the filling chamber 10.

As already mentioned, the connecting line 13 is arranged vertically in the center of the coolant expansion tank 90. Its left exterior wall, in FIG. 1 has the reference number 51, and its right exterior wall has the number 52. In parallel to these two exterior wall 51 and 52 of the connecting line 13, two walls 50 and 53 are provided, in which case the wall 50 limits the expansion chamber 11 on its right-hand side, and the wall 53 limits the filling chamber 10 on its left-hand side. The walls 50 and 51 as well as the walls 52 and 53 are in each case connected with one another. As a result, the walls 50 and 51 enclose a testing space section 55 of a testing chamber 58, and the walls 52 and 53 enclose a testing space secton 56 of the testing chamber 58. The right testing space section 56, that is adjacent to the filling chamber 10, has an opening 66 connected to the exterior of the coolant expansion tank 90 adjacent to the bottom side 42 of the coolant expansion tank 90. Similarly, the testing space section 55, that is adjacent to the expansion chamber 11, has a corresponding opening 65 at its upper end located at the top side 41 of the coolant expansion tank 90.

The coolant expansion tank 90 shown in FIG. 1 consists of two housing halves 45 and 46. These are fitted together along a parting line 30. In this case, the parting line 30 extends horizontally approximately in the center or the coolant expansion tank 90. The parting line 30 divides the filling chamber 10, the expansion chamber 11 and the connecting line 13, in each case, into two parts.

In the area of the connecting line 13 and of the testing space sections 55 and 56, the parting line 30 is marked by special reference numbers. Thus, the partng line of the wall 50 has the reference number 80; the parting line of the wall 51 has the reference number 81; the parting line of the wall 52 has the reference number 82; and the parting line of the wall 53 has the reference number 83. All parting lines 30, 80, 81, 82 and 83 in this case are located on the already mentioned joining plane.

FIG. 2 is a view of the left front side 43 of the coolant expansion tank 90 of FIG. 1. This front side 43 has a rectangular shape and is delimited by the top side 41, the bottom side 42, the longitudinal side 71 visible in FIG. 1 and the longitudinal side 70. FIG. 2 also shows the position of the feeding connection piece 15 in the area of the longitudinal side 71, the position of the valve connection piece 18 adjacent to the longitudinal side 70, the position of the inlet connection pieces 25 located underneath the valve connection piece 18, and the central position of the suction connection piece 26. Finally, FIG. 2 also again contains the exterior walls 60 and 61 of the ducts 37 and 38 that project above the top side 41 and below the bottom side 42 of the coolant expansion tank 90. In this case, the exterior walls 60 and 61 do not extend over the whole width of top and bottom sides 41 and 42, therefore not from the longitudinal side 70 to the longitudinal side 71 of the coolant expansion tank 90, but only over a smaller area in the center of the top side 41 and the bottom side 42.

FIG. 3 again shows the walls 50, 51, 52, and 53 that enclose the testing space sections 55 and 56. While the walls 51 and 52 are exterior walls of the connecting line 13, the walls 50 and 53 extend over the whole width of the coolant expansion tank 90 from longitudinal side 70 to longitudinal side 71. As a result, the testing space sections 55 and 56, on both sides of the connecting line 13, combine to form one testing space section 57 of the testing chamber 58 respectively. For this purpose, the walls 50 and 53, in the area of the connecting line 13, are developed to be arc-shaped so that, outside the connecting line 13, they extend in parallel to one another. On the longitudinal side 70 of the coolant expansion tank 90, the testing space section 57 is delimited by a wall 62 and on the longitudinal side 71 by a wall 63. At the bottom side 42 of the coolant expansion tank 90, the testing space section 57 is delimited by a wall 68 and at the top side 41, by a wall 69. Because of the viewing direction onto the sectional plane A—A of FIG. 1, in FIG. 3, the opening 66 of the testing space section 55 is located above the plane of projection of FIG. 3.

In FIG. 4, the testing space section 57 is represented as a sectional view along plane B—B of FIG. 3. Thus FIG. 4 corresponds in principle to the partial section of FIG. 1, in which case, however, in FIG. 1, the partial section was taken along a plane intersecting with the connecting line 13. FIG. 4 again shows the walls 50 and 53 that enclose the testing space section 57, as well as the two housing halves 45 and 46 that, in the area of the walls 50 and 53, form the parting lines 80 an 83. Finally in FIG. 4, openings 77 and 78 are also shown that are located in the wall 68 at the bottom side 42 of the coolant expansion tank 90 and in the wall 69 of the top side 41 of the coolant expansion tank 90. Because of the viewing direction onto the sectional plane B—B of FIG. 3, the openings 77 are also shown in FIG. 3.

For the checking of the tightness of the described coolant expansion tank 90, a testing agent is filled into it, possibly under excess pressure. If one of the exterior walls of the coolant expansion tank 90 leaks, the testing agent emerges at this point, making the leakiness immediately recognizable. If, on the other hand, the connecting line 13 or one of the two walls 50 and 53 of the expansion chamber 11 and of the filling chamber 10 are leaky, the testing agent emerges into at least one of the testing space sections 55, 56 and 57. From there, through at least one of the openings 65, 66, 77 or 78, it leaves the mentioned testing space sections and can therefore be noticed from the outside. Thus the leakiness of the connecting line and/or one of the partitions of the coolant expansion tank 90 can be recognized. Both tests can be carried out in the same work step. The job of a tester in the case of this work step, consists of feeding in the testing agent and of monitoring whether testing agent emerges at the exterior walls or at the openings of the coolant expansion tank 90.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A coolant exapnsion tank, particularly for internal-combustion engines, comprising:

at least one filling chamber means for receiving the coolant;

at least one expansion chamber means;

means connecting said filling and expansion chambers;

a double wall partition means, separating the filling and the expansion chamber means, for forming a monitorable testing space;

said filling and expansion chamber means being unitary and consists of at least two housing parts that are fitted together along a parting line forming a joining plane.

2. A coolant expansion tank according to claim 1, wherein the joining plane intersects with the partition means.

3. A coolant expansion tank, particularly for internal-combustion engines, comprising:

at least one filling chamber means for receiving the coolant;

at least one expansion chamber means;

means connecting said filling and expansion chambers; and a double wall partition means, separating the filling and the expansion chamber means, for forming a monitorable testing space, said partition means having at least one opening leading to the exterior of said tank.

4. A coolant expansion tank according to claim 3, wherein said partition includes a pair of partition connected with transverse walls to form a testing chamber.

5. A coolant expanstion tank according to claim 4, wherein at least one of said transverse walls has at least one opening leading to the exterior of said tank.

6. A coolant tank according to one of claims 3, wherein said connecting means transverse said partition means.

7. A coolant exapnsion tank according to claim 3, wherein said partition means extends the height and width of said filing and expansion chamber means.

8. A coolant expansion tank, particularly for internal-combustion engines, comprising:

at least one filling chamber means for receiving the coolant;

at least one expansion chamber means;

means connecting said filling and expansion chambers;

a double wall partition means, separating the filling and the expansion chamber means, for forming a monitorable testing space; and said connecting means includes a conduit extending from adjacent the top of said filling chamber means through said partition means to adjacent the bottom of said expansion chamber means.

9. A coolant expansion tank according to claim 8, wherein a portion of said conduit extends above said filling chamber means and a portion of said conduit extends below said expansion chamber means.

* * * * *